US009074413B1

(12) United States Patent
Sprague

(10) Patent No.: US 9,074,413 B1
(45) Date of Patent: Jul. 7, 2015

(54) RAIL, STILE, MULLION, DOOR AND WALL JAMB ASSEMBLIES FOR FRAMING GLASS DOORS AND WALL PARTITIONS

(71) Applicant: Gary Sprague, Los Angeles, CA (US)

(72) Inventor: Gary Sprague, Los Angeles, CA (US)

(73) Assignee: C.R. LAURENCE CO., INC., Los Angeles, CA (US)

( * ) Notice: Subject to any disclaimer, the term of this patent is extended or adjusted under 35 U.S.C. 154(b) by 0 days.

(21) Appl. No.: 14/328,592

(22) Filed: Jul. 10, 2014

(51) Int. Cl.
*E06B 7/00* (2006.01)
*E06B 3/58* (2006.01)

(52) U.S. Cl.
CPC ..... *E06B 3/5821* (2013.01)

(58) Field of Classification Search
CPC . E06B 3/5821; E06B 3/9636; E06B 3/66309; E06B 3/66304; E06B 3/5454; E04B 2/96; E04B 2/967; E04B 2/7455; E04B 2/88; F16B 5/0635
USPC ..... 52/204.65, 204.595, 204.593
See application file for complete search history.

(56) References Cited

U.S. PATENT DOCUMENTS

| | | | | | |
|---|---|---|---|---|---|
| 1,729,586 | A | | 9/1929 | Liebman | |
| 2,633,946 | A | | 4/1953 | Huizenga | |
| 2,777,173 | A | * | 1/1957 | Caswall | 52/800.14 |
| 2,808,136 | A | * | 10/1957 | Hammitt et al. | 52/770 |
| 3,267,631 | A | * | 8/1966 | Hammitt | 52/771 |
| 3,282,007 | A | * | 11/1966 | Campbell et al. | 52/475.1 |
| 3,844,084 | A | * | 10/1974 | Hubbard et al. | 52/843 |
| 3,978,629 | A | * | 9/1976 | Echols, Sr. | 52/235 |
| 4,054,268 | A | * | 10/1977 | Sher | 256/24 |
| 4,235,049 | A | * | 11/1980 | Marinoni et al. | 49/493.1 |
| 4,655,025 | A | * | 4/1987 | Marinoni | 52/771 |
| 4,671,016 | A | | 6/1987 | Boeckx | |
| 4,680,903 | A | | 7/1987 | Horgan | |
| 4,763,453 | A | * | 8/1988 | Horgan, Jr. | 52/127.8 |
| 4,837,993 | A | | 6/1989 | Studenski | |
| 4,914,888 | A | * | 4/1990 | Hanson | 52/768 |
| 4,947,597 | A | * | 8/1990 | Simpson | 52/208 |
| 5,444,958 | A | | 8/1995 | Lu | |
| 5,875,600 | A | | 3/1999 | Redman | |
| 6,016,632 | A | * | 1/2000 | McGee et al. | 52/241 |
| 6,434,905 | B1 | | 8/2002 | Sprague | |
| 6,799,404 | B2 | * | 10/2004 | Spransy | 52/582.1 |
| 6,912,818 | B2 | | 7/2005 | Sprague | |
| 7,584,588 | B2 | | 9/2009 | Kim | |
| 7,963,077 | B2 | | 6/2011 | Lin | |
| 8,042,316 | B2 | * | 10/2011 | Lee et al. | 52/784.11 |

(Continued)

FOREIGN PATENT DOCUMENTS

| | | |
|---|---|---|
| JP | 7109874 | 4/1995 |
| JP | 2006291478 | 10/2006 |
| WO | 2013/064985 | 10/2013 |

*Primary Examiner* — Brian Glessner
*Assistant Examiner* — Gisele Ford
(74) *Attorney, Agent, or Firm* — Cislo & Thomas, LLP

(57) ABSTRACT

Rail, stile, wall jamb, mullion and sidelight rail assemblies for framing doors and wall partitions are presented. The rail assembly includes a rail body and a spring action clamping member. The rail assembly features geometry that utilizes wedging action to convert axial force exerted by clamp screws into a perpendicular clamping force against faces of the panel to be secured. The stile, mullion, wall jamb and sidelight rail assemblies present additional means for securing and framing a panel. The framing assemblies herein presented are particularly well-suited for use with insulated glass panels, i.e. glass panels constructed from two panes of glass which are separated by spacers.

19 Claims, 9 Drawing Sheets

(56) References Cited

U.S. PATENT DOCUMENTS

| | | | | |
|---|---|---|---|---|
| 8,069,010 | B2 * | 11/2011 | Choi et al. | 702/179 |
| 8,181,405 | B2 * | 5/2012 | Nash | 52/238.1 |
| 8,402,714 | B2 * | 3/2013 | Labrecque | 52/745.09 |
| 8,555,576 | B2 * | 10/2013 | Falk | 52/235 |
| 8,578,668 | B2 * | 11/2013 | Joray | 52/207 |
| 8,650,827 | B2 * | 2/2014 | Givoni et al. | 52/588.1 |
| 2002/0056240 | A1 * | 5/2002 | Missier | 52/208 |
| 2002/0100234 | A1 * | 8/2002 | Sprague | 52/208 |
| 2002/0124499 | A1 * | 9/2002 | Braybrook | 52/235 |
| 2002/0195595 | A1 * | 12/2002 | Shepherd | 256/25 |
| 2003/0226324 | A1 * | 12/2003 | Hogan | 52/235 |
| 2006/0070318 | A1 | 4/2006 | Chen et al. | |
| 2006/0185273 | A1 * | 8/2006 | Lathief | 52/204.71 |
| 2008/0092464 | A1 * | 4/2008 | Haab et al. | 52/204.7 |
| 2008/0236095 | A1 * | 10/2008 | Kim | 52/784.16 |
| 2009/0241466 | A1 * | 10/2009 | Gussakovsky | 52/786.1 |
| 2010/0205880 | A1 * | 8/2010 | Lin | 52/207 |
| 2010/0257812 | A1 * | 10/2010 | Schultz et al. | 52/704 |
| 2010/0293882 | A1 * | 11/2010 | Labrecque et al. | 52/705 |
| 2010/0307386 | A1 * | 12/2010 | Stockhausen et al. | 109/79 |
| 2012/0317894 | A1 * | 12/2012 | Von Hoyningen Huene et al. | 52/29 |
| 2014/0069030 | A1 * | 3/2014 | Boissevain et al. | 52/28 |
| 2014/0220268 | A1 * | 8/2014 | Dreux | 428/34 |

* cited by examiner

RAIL, STILE, MULLION, DOOR AND WALL JAMB ASSEMBLIES FOR FRAMING GLASS DOORS AND WALL PARTITIONS

FIELD OF THE INVENTION

The invention relates to vertical and horizontal framing members for framing glass doors, wall partitions and like structures, and in particular to framing insulated glass panels comprised of two panes of glass separated by spacers.

BACKGROUND OF THE INVENTION

Vertical glass panels such as doors or wall partitions typically have bottom and top edges that are secured within horizontal rails. The vertical edges of the glass panels may be left free or may be secured within vertical stile, mullion, or door or wall jamb members for additional protection. The framing members are typically made from lightweight materials such as aluminum and are provided with decorative finishes or covers to create a pleasing ornamental appearance. The appeal of glass panel framing systems has been limited however, by the difficulty and cost of installing known systems and by the costs and inconvenience of repairing a damaged or marred glass framing member after initial installation.

In many common structural glass panel framing systems, glass panels are fitted into channels formed within the rails, stiles, mullions and door/wall jamb assemblies and secured within the framing members by means of an adhesive sealant. This type of construction makes it difficult or impossible to remove the framing member from the panel after the adhesive sealant has cured. The inability to readily remove a framing member for replacement is generally considered to be a disadvantage of these permanent attachment designs because, over time, the framing members and/or glass become marred from use and replacement is desirable in many commercial applications to maintain aesthetics. The installation of permanent attachment designs also requires substantial skilled labor and time at the job site.

To address some of the disadvantages of prior art permanent attachment framing systems, designs that clamp onto the glass panels have been developed. These new designs have allowed for the ready replacement of damaged framing members and/or glass panels and have reduced the time required to frame glass panels. Several such clamp-on rail, stile, mullion and wall/door jamb designs have been developed. Generally, each type relies upon the application of clamping force to retain a glass panel within a channel which forms part of the framing member. The clamping action is typically produced either by screws bearing directly against clamping strips which bear against the glass panes or by wedging action whereby wedge blocks are pulled downwardly or pushed upwardly against mating angled walls to force the blocks inwardly against the glass panels to create clamping pressure.

One drawback of the prior art clamping systems for attaching framing members to glass panes is the inability to precisely control the degree of clamping force applied to the panes. This problem is of particular concern in the installation of insulated glass panels. Insulated glass panels typically comprise two glass panes which are separated by a spacer. Problems occur because the spacer is often hollow to reduce weight and may be crushed if overstressed during installation of the framing members. In addition the individual glass panes used in insulated glass panels are generally substantially thinner than the panes of conventional single glass panels and hence are more subject to cracking during the installation of framing members.

Despite improvements in the glass panel framing art, there remains a need for structural glass framing members that are easy to install, allow for the replacement of component parts, and which maintain a uniform, controlled, clamping pressure on the glass panes.

SUMMARY OF THE INVENTION

The present invention presents rail, stile, mullion and door/wall jamb assemblies that may be used together to form a system that releasably frames the horizontal and vertical edges of a panel oriented in a vertical direction. The rail, stile, mullion and door/wall jamb assemblies maintain a uniform, controlled clamping pressure on the panel to be secured, are easy to install, and due to their releasable nature allow for the replacement of component parts. The rail, stile, mullion and door/wall jamb assemblies herein presented may also be readily scaled in size to accommodate a wide range of thicknesses of the panel to be secured.

The rail assembly of the invention features geometry that utilizes wedging action to convert an axial force into a perpendicular clamping force against the faces of the panel to be secured. The rail assembly may be used with panels made from virtually any type of material, but is particularly well-suited for use with double pane glass panels, i.e. panels constructed from two panes of glass which are separated by spacers, also commonly referred to as insulated glass panels.

The rail assembly of the present invention includes among its major features a rail body, a spring action clamping member, and screws for providing axial force to actuate the clamping components. Surrounding the rail body is a decorative cladding member. Upper surfaces of the rail body are angled inwardly with respect to the vertical direction of the panes of the insulated glass panel or panel to be secured. The rail body further includes channel walls which define at a lower end of the rail body a lower channel space. The lower channel space provides for easy access to the clamp screws which are contained therein. Similarly, the channel walls define at an upper end of the rail body a glass panel receiving space. The glass receiving space houses the spring action clamping member.

Applied force from the clamp screws causes the spring action clamping member to move upwardly within the glass panel receiving channel and therein causes a horizontal and inwardly directed clamping force to be generated as upper ends of the spring action clamping member are driven upwardly against the inwardly angled upper surfaces of the rail body.

The angled upper surfaces of the rail body cause the upper ends of the spring action clamping member to translate or move horizontally inwardly causing compression gaskets to contact the faces of the pane(s) of the panel to be secured. Upon contact of the compression gaskets with the faces of the panel to be secured and upon continued upward movement and consequent inward translation of the upper ends of the spring action clamping member, clamping force is generated against the faces of the panel to be secured.

The vertical stile and door jamb assemblies presented herein use a main channel and two mutually opposed C-channel section glass support channels received within the main channel. Set screws housed within the main channel bear against an outer wall of the C-channel section of the glass support channels which drives an inner wall of the glass support channels against a pane or face of the panel to be secured and therein creates clamping pressure which secures the stile or door jamb to the edge of the panel to be secured.

Inward motion of each glass support channel is controlled and limited by a positive stop formed in main channel. The positive stop feature limits the amount of clamping pressure which can be applied to the panel to be secured. This feature is particularly valuable when the panel to be secured is an insulated glass panel and thereby prevents possible crushing of the spacer the separates the panes of an insulated glass panel, as well as possible cracking of the panes themselves. The stile and door jamb also provide the vertical edges of insulated glass panels with a smooth pleasing appearance.

DETAILED DESCRIPTION OF THE PREFERRED EMBODIMENTS

The present invention will now be described more fully hereinafter with reference to the accompanying drawings, in which preferred embodiments of the invention are shown. The invention may, however, may be embodied in many different forms and should not be construed as being limited to the embodiments set forth herein. Rather these embodiments are provided so that this disclosure will be thorough and complete, and will fully convey the scope of the invention to those skilled in the art. Like numbers refer to like elements throughout.

Figure 1:
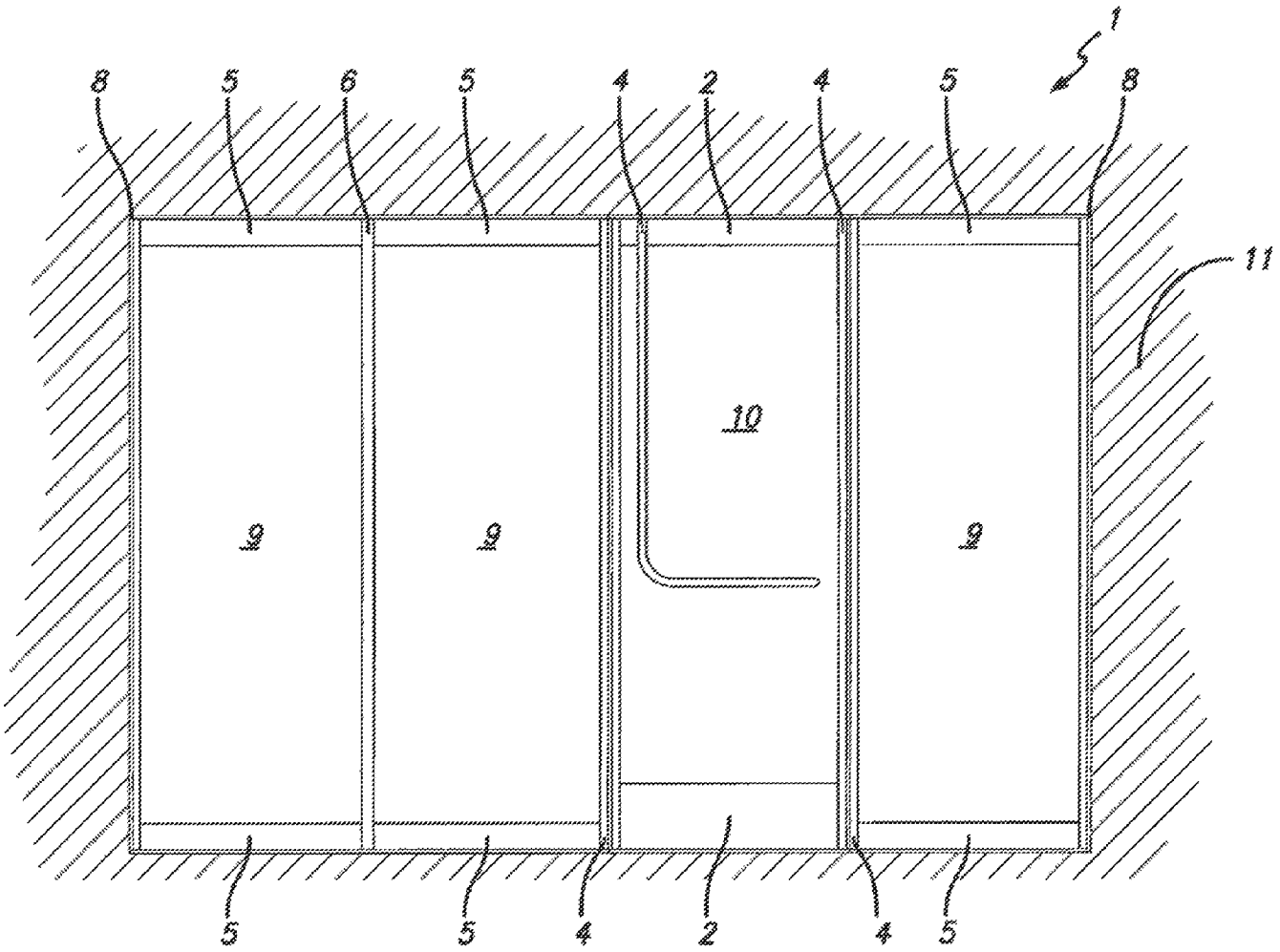
FIG. 1 depicts a representation of a wall featuring a representative swinging glass door and three representative glass wall partitions. The swinging glass door and glass wall partitions are shown framed with representative vertical and horizontal farming members

With reference to FIG. 1, an exemplary storefront installation 1 of a fully framed swinging glass door 10 and fully framed glass wall partitions 9, set within a wall 11, are shown. The glass door 10 is framed by horizontal rail assemblies 2 at its bottom and top horizontal ends, as well as by vertical stile assemblies 4 on each vertical end. The vertical stile assemblies 4 are also suitable for use as door jambs. The glass wall partitions 9 are framed by horizontal sidelight rails 5 and combinations of vertical framing members which may be wall jambs 8, mullions 6 or door jambs 4.

Figure 2:
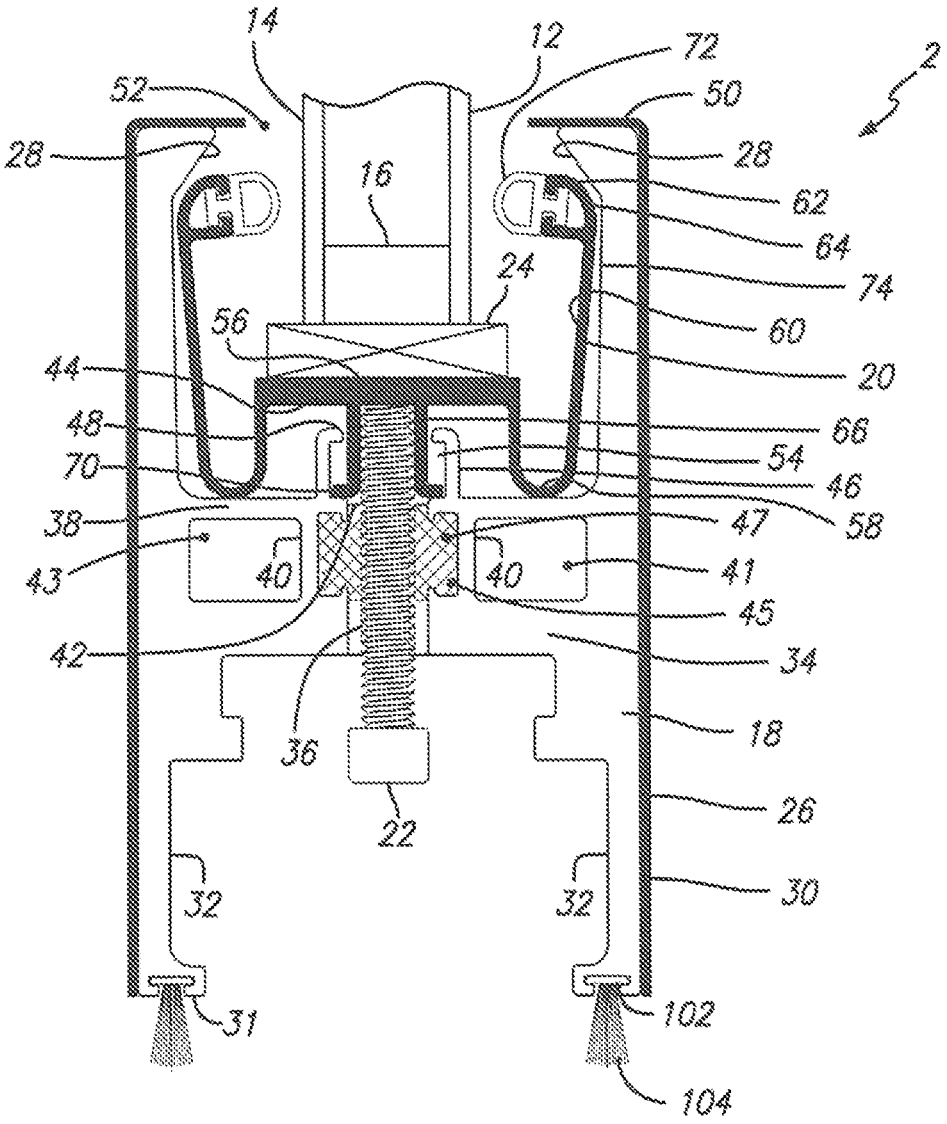
FIG. 2 is an exemplary end view of a horizontal rail assembly constructed in accordance with the present invention, showing the rail assembly in an unclamped position.
Figure 3:
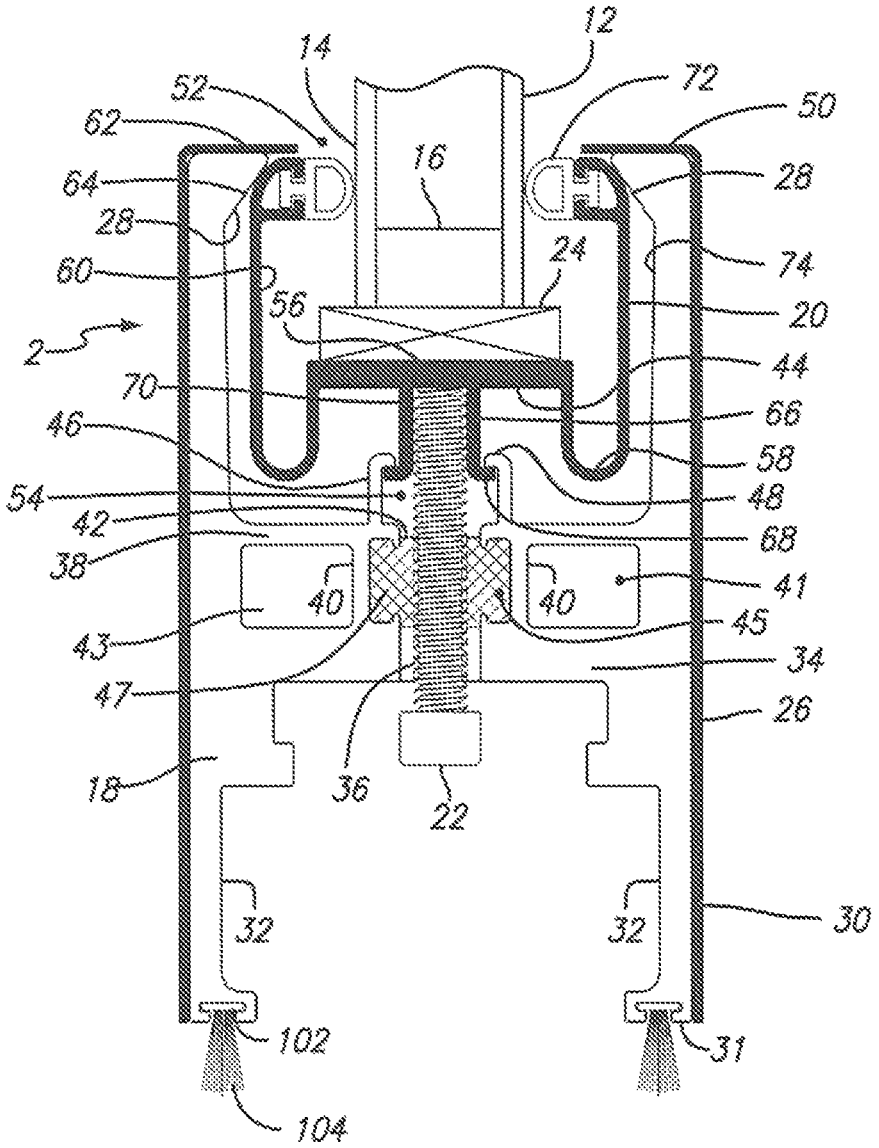
FIG. 3 is an exemplary end view of the rail assembly constructed in accordance with the present invention of FIG. 1, showing the rail assembly in a clamped position.

Referring to FIGS. 2-3, an exemplary embodiment of the rail assembly 2 of the present invention is presented. The rail assembly 2 is designed to clamp to the outer edges of a glass panel to be secured 12. The glass panel may be of single or double pane construction. Double pane glass panels are commonly referred to in the art as insulated glass panels. Illustrated in FIGS. 2-6 and 9-11 is an insulated glass panel 12 which comprises two panes of glass 14 which are separated by spacers 16, as is known in the art. While the rail assembly 2 of the present invention is intended to be used with glass panels, it is not limited to such use and will function equally well with panels made from virtually any type of material available in sheet form including Lexan, Plexiglas and other types of polycarbonate or acrylic panels, as well as panels formed from metallic, fiber or even wood based materials.

With continued reference to FIGS. 2-3, the present invention rail assembly 2 comprises a rail body 18, a spring action clamping member 20, clamp screws 22, and a glass panel support spacer 24. Surrounding the rail body 18 is a decorative cladding member 26. Inwardly angled upper surfaces 28 of rail body 18 are angled (inwardly) with respect to the vertical direction of the panes 14 of the insulated glass panel 12. The rail body 18 further includes channel walls 30 which define at a lower end 31 of the rail body a lower channel space 32. The lower channel space 32 provides for easy access to the clamp screws 22 and may, optionally be covered by a close out panel (not shown). The depth of the lower channel space may vary depending on upon whether the rail is used in a bottom rail application or a top rail application. Similarly, the channel walls 30 define at an upper end 50 of the rail body a glass panel receiving space 52. The glass receiving space 52 houses the spring action clamping member 20, the glass panel support spacer 24, and the glass panel 12.

For aesthetic as well as practical reasons, i.e. protection from scuffing caused by footwear or baggage it may be desirable to use a comparatively deep channel space 32 in bottom rail applications and a comparatively shallow channel space 32 in top rail applications.

The rail body 18 also includes a lower compression member 34 which has threaded holes 36 (see FIGS. 2-3 and 8) located at intervals to accommodate the clamp screws 22, and an upper compression member 38, which features clearance holes 42, located at intervals, that allow the clamp screws 22 to pass through the upper compression member 38 wherein the ends of the clamp screws 22 abut an abutment surface 44 located on the spring action clamping member 20. Interconnecting the upper compression member 38 and lower compression member 34 are interior walls 40, which define interior channels 41, 43 and 45. Extending upwardly from the upper compression member 38 are mutually opposing walls 46 which feature inwardly facing hook ends 48. The mutually opposed walls 46 define a center channel 54.

With continued reference to FIGS. 2-3, the spring action clamping member 20 comprises a glass panel support base 56 from which extend upwardly via downwardly located U-shaped sections 58 mutually opposed spring walls 60. Upper ends 62 of the spring walls 60 include sliding surfaces 64. The sliding surfaces 64 of the spring action clamping member 20 slideably engage with the top portions 28 of the rail body 18. The sliding surfaces 64 are depicted as radiused surfaces in the exemplary embodiment. However, the sliding surfaces are not limited to being radiused surfaces but may also be inclined or angled surfaces. Attached to the upper ends 62 of the spring walls 60 are compression gaskets 72. The compression gaskets 72 apply and maintain compressive force against the panes 14 of the insulated glass panel 12 when the rail assembly 10 is in the closed or clamped position (see FIG. 3).

The spring action clamping member 20 also features mutually opposed walls 66 that extend downwardly from the glass support base 44 to define a center channel 70 therebetween. The walls 66 include outwardly extending flanges 68. The outwardly extending flanges 68 slide within center channel 54 of the rail body 18 and are movable via the clamp screw 22 from an open or unclamped position (see FIG. 2) and a closed or clamped position (see FIG. 3). In the closed or clamped position the outwardly extending or facing flanges 68 of the walls 66 of the spring action clamping member 20 engage the inwardly facing hook ends 48 of the walls 46 of the rail body 18. The inwardly facing hook ends 48 and the outwardly extending flanges 68 therefore define a positive stop that limits upward travel of the spring action clamping member.

The channel 70 between the downwardly extending walls 66 of the glass support base 44 of the spring action clamping member 20 receives the clamp screws 22 which bear on the abutment surface 44 of the spring action clamping member 20.

Figure 8:
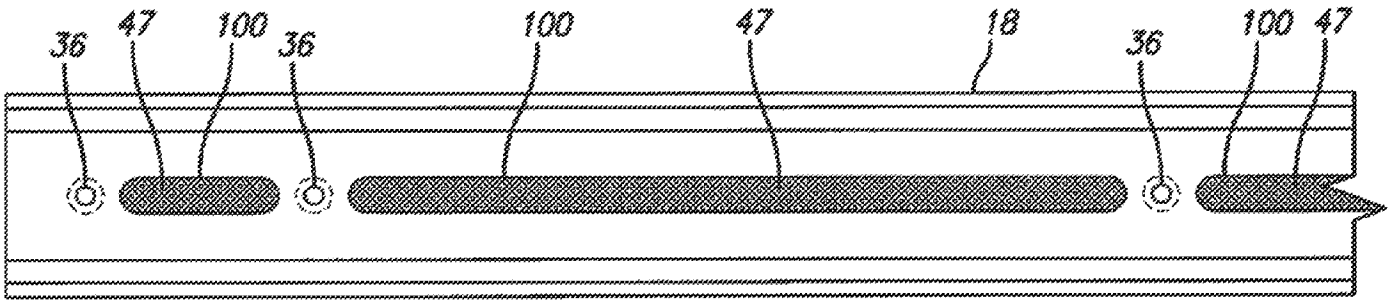
FIG. 8 is a bottom plan view of a horizontal rail assembly of the present invention.
Figure 9:
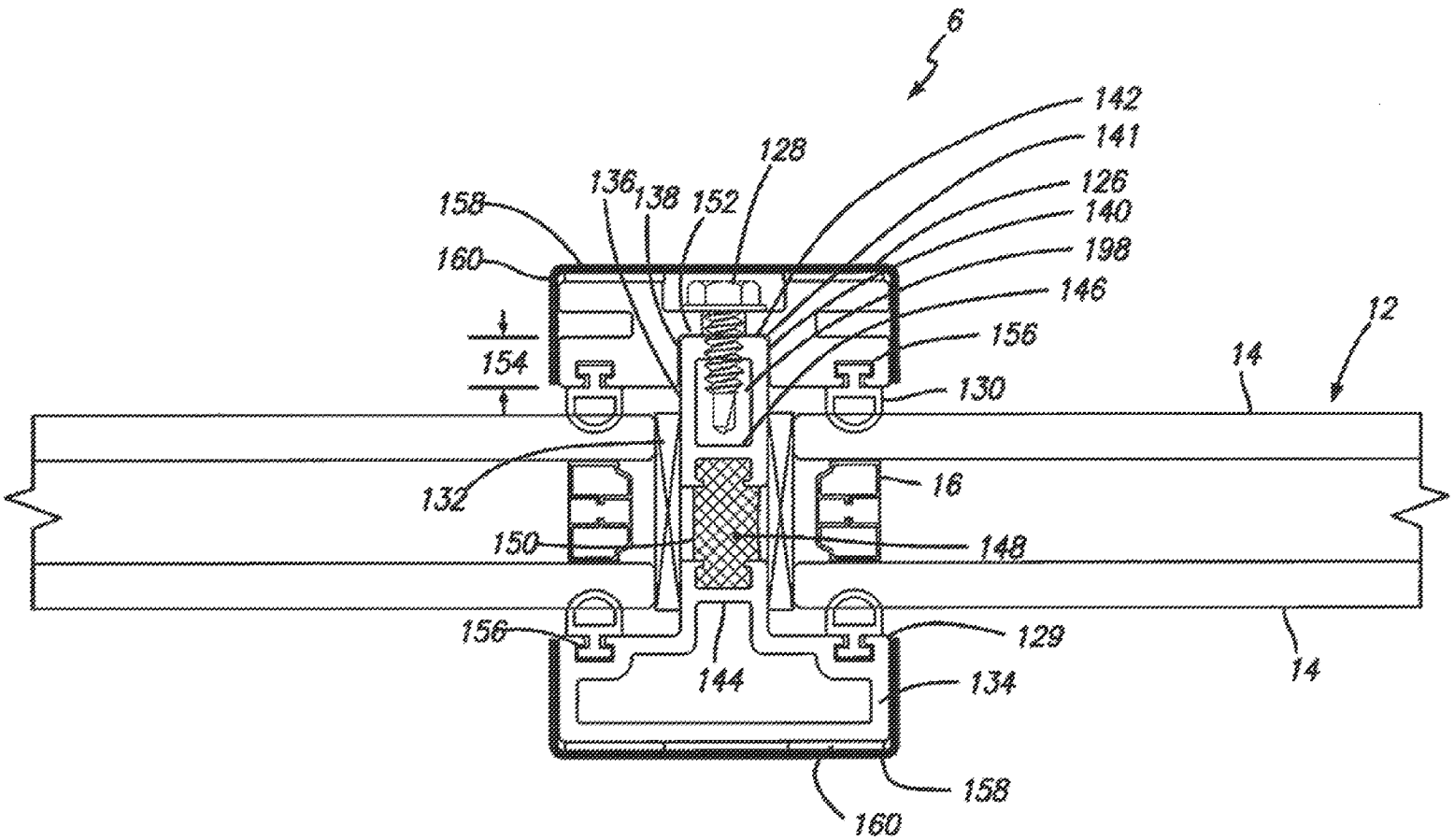
FIG. 9 is an exemplary end view of a vertical mullion assembly constructed in accordance with the present invention.

With reference to FIGS. 2-3 and in particular, FIG. 8, in order to provide for improved thermal isolation of the rail assembly 2, slots 100 are machined in the rail body 18 above the channel 45 which opens one wall of the channel to allow for filling of the channel with a thermal epoxy 47. Thermal epoxies with good insulating qualities are known in the art.

With reference to FIGS. 2-3, the lower ends 31 of the rail body 18 may be equipped with weather seal installation channels 102 and snap-in weather seals 104.

With continued reference to FIGS. 2-3, the operation of the rail system described above is herein explained. Generally, clamping force is generated via wedging action, i.e. an applied force in one direction is converted into to an applied force in a perpendicular direction by the sliding of a driven member against the inclined surface of a non-driven member.

With reference to FIGS. 2-3, in the open or unclamped position, the upper ends 62 of the spring action clamping member 20 rest in contact with interior walls 74 of the glass channel receiving space 52. (See FIG. 2.) Outwardly directed spring force is created by the U-shaped sections 58 of spring action clamping member which interconnect the walls 60 with the glass panel support base 56. The degree of outwardly directed spring force may be varied by varying the bend radius of the U-shaped sections 58.

With the rail assembly 2 in the open position, a glass panel, such as the insulated glass panel 12 is centrally positioned within the glass panel receiving channel 52 of the rail body 18 and rests upon the spacer 24. Thereafter, clamp screws 22 are tightened which create an axial and upwardly directed driving force which is applied to the spring action clamping member 20 at abutment surface 44. The applied force from the clamp screws 22 causes the spring action clamping member 20 to move upwardly within the glass panel receiving channel 52 and therein causes a horizontal and inwardly directed clamping force to be generated as the upper ends 62 of the spring action clamping member 20 are driven upwardly against the inwardly angled upper surfaces 28 of the rail body 18.

Because the angled upper surfaces 28 of the rail body 18 are angled inwardly towards the panel to be secured 12, the upper ends 62 of the spring action clamping member 20 translate or move horizontally inwardly causing the compression gaskets 72 to contact the panes 14 of the glass panel to be secured 12. (In the case of single pane panel, the compression gaskets would contact the exterior faces of the single pane.) Upon contact of the compression gaskets 72 with the panes 14 of the glass panel to be secured 12 and upon the continued upward movement and consequent inward translation of the upper ends 62 of the spring action clamping member, clamping force is generated against the glass panes 14 of the glass panel to be secured 12.

The generation of clamping force ceases when the outwardly extending flanges 68 of the walls 66 of the spring action clamping member 20 contact the hook ends 48 of the walls 46 of the rail body 18. (See FIG. 3.) The ability of the outwardly facing flanges 68 of the spring action clamping member 20 to slide within center channel space of the rail body 18 between an open or unclamped position (see FIG. 2) and a closed or clamped position (see FIG. 3), is a salient feature of the rail assembly 2 because the degree of clamping force applied may be controlled by varying the height of the walls 46 and consequently the height of the hook ends 48 of the rail body 18. This feature allows for a specific degree of clamping force to be uniformly applied to the glass panel to be secured 12. This feature also eliminates the need to use torque-to-yield fasteners and/or a torque wrench in installing the rail system.

Experimentation has shown that clamping forces in the range of 3 to 10 pounds per linear inch to be well suited for use with insulated glass comprising two panes of glass of approximately inch thickness separated by a spacer of about ½ inch, which is a common configuration in the industry. The rail assembly 2 of the present invention may be scaled to provide clamping forces above or below the above range as may be needed for other glass panel configurations.

Figure 4:
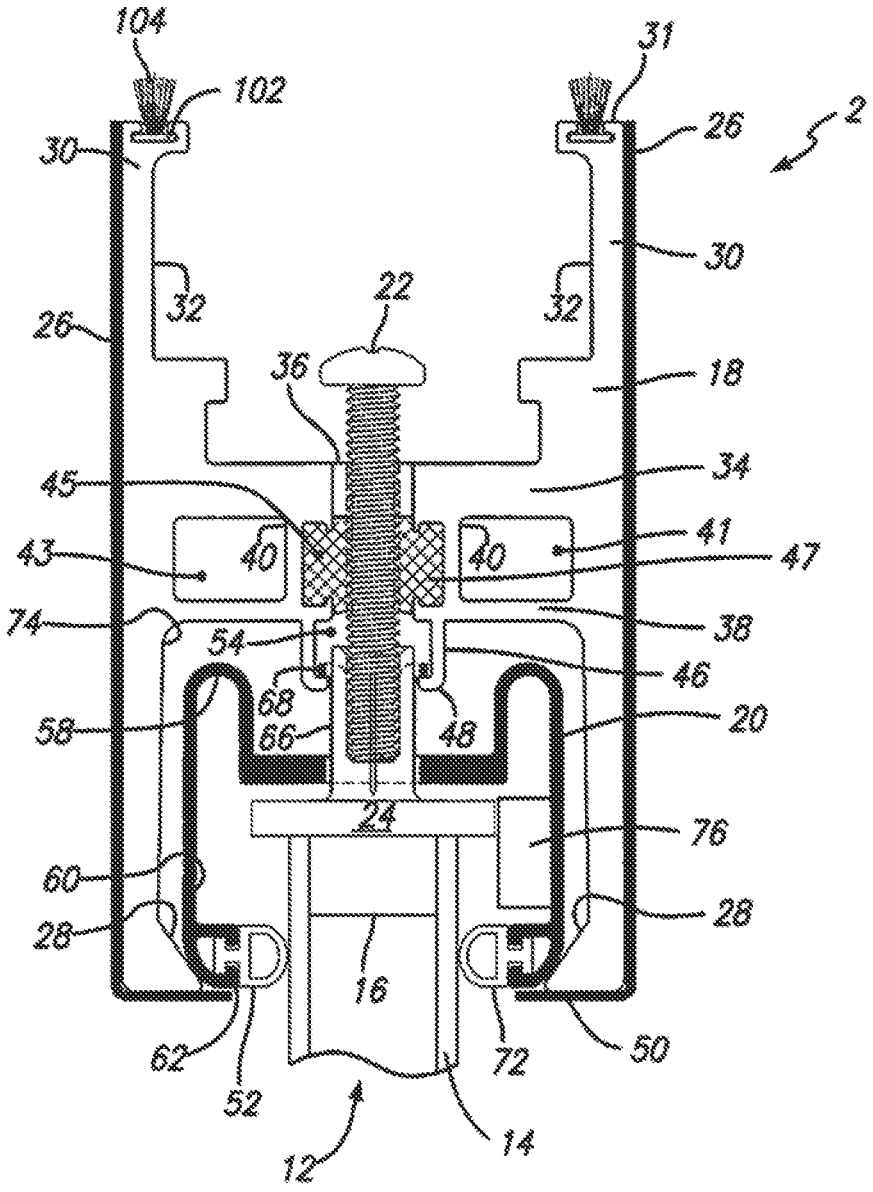
FIG. 4 is an exemplary end view of the rail assembly constructed in accordance with the present invention of FIG. 1, showing the rail assembly in a clamped position, in a top rail configuration.

With reference to FIG. 4, the rail assembly 2 of the present invention is depicted in a top rail application. Unlike in the bottom rail application shown in FIGS. 2-3, in a top rail application the rail assembly need not support the weight of the glass panel 12. Therefore, the spacer 24 may, optionally, be composed of a substantially rigid or inelastic material as the spacer 24 is not required to cushion the glass panel to be secured 12 from shock. In addition, limit spacers 76 may be added in a top rail application to minimize side to side movement, if any, of the glass panel between the compression gaskets 72.

The rail body 18 and the spring action clamping member 20 are preferably aluminum extrusions. In the exemplary embodiment, the rail body is covered by cladding 26 to provide an attractive exterior appearance. The cladding 26 will typically be of polished or brushed finish stainless steel or brass, or polished, brushed or anodized aluminum. In some embodiments, cladding may not be used in which case the rail body may be provided with an attractive exterior finish by means of anodizing or other processes known in the art. The spring action clamping member 20 is enclosed within the rail body 18 and therefore requires no particular finishing for esthetic reasons.

The clamp screws 22 will typically be socket head cap screws although many other types of fasteners may be used and are known in the art. As is common in clamping applications, threaded fasteners are the preferred method of actuating the rail assembly components to generate clamping forces.

The spacers 24 and 76 will typically be made of an elastomeric material such as neoprene or other synthetic rubber-like material. Alternative materials include cork, cork/rubber composites and fiber based composites. Various plastic materials are also suitable, particularly in top rail applications.

Generally, single pane glass doors will feature rails at the top and bottom of the doors with the exposed vertical side edges being polished which provides for pleasing esthetics. Double pane glass doors or wall partitions on the other hand lack a clean single edge and therefore must be fitted with a vertical framing member, known in the art as a stile in the case of a glass door, or as mullion, door jamb or wall jamb in the case of glass wall partitions, to provide for an attractive appearance.

Figure 5:
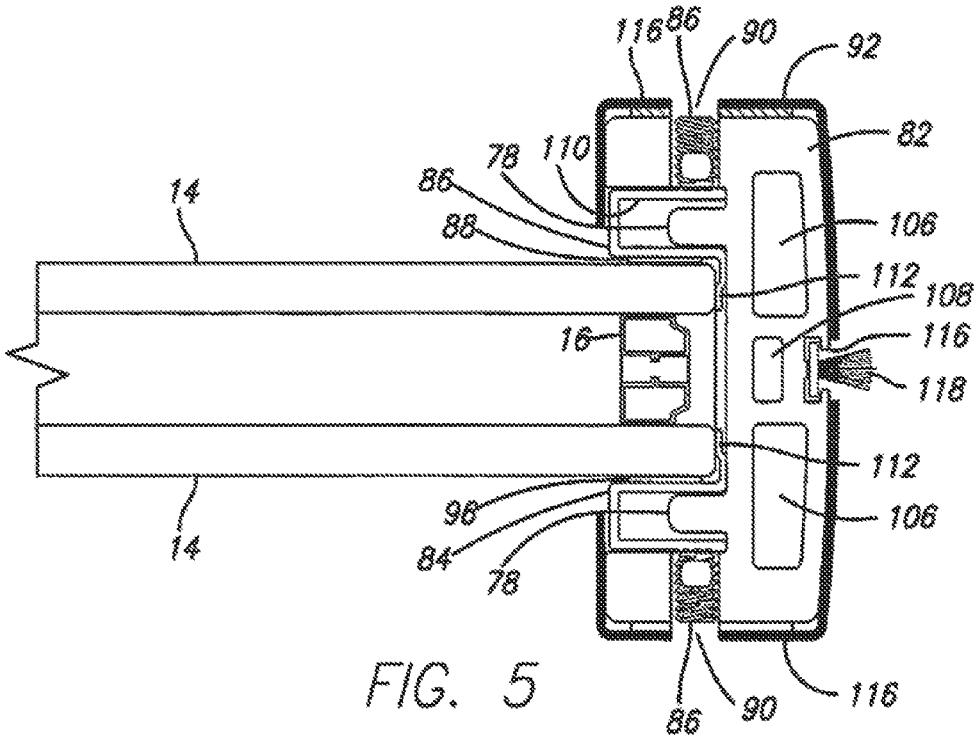
FIG. 5 is an exemplary cross-sectional view of a vertical stile or door jamb assembly constructed in accordance with the present invention, taken along the line A-A of FIG. 7.

Referring now to FIG. 5, a vertical stile assembly 4 suitable for use with insulated glass, i.e. double pane glass panels, is shown. The vertical stile assembly 4 is equally suitable for use as a door jamb. The vertical stile assembly 4 includes a main channel or extrusion 82, two mutually opposed glass support channels or extrusions 84, configured to be received within the main channel 82, set screws 86, and exterior cladding 92. The main channel 82 includes positive stops 98 which limit the inward travel of the glass support channels 84. The main channel 82 also includes threaded holes 90 for receipt of the set screws 86, as well as lightening channels 106 and a center channel 108. The lightening channels 106 and center channel 108 serve to minimize the weight of the main channel or extrusion 82.

The glass support channels 84 are configured as C-channels with an outer wall 110 and an inner wall 96, as well as am inwardly facing glass support extension flange 112. The inner walls 96 bear against the panes 14 of the insulated glass panel to be secured 12. Disposed between the inner walls 96 and panes 14 of the insulated glass panel to be secured 12 are double sided adhesive tape strips 88. The adhesive tape strips 88 serve to secure the glass support channels 84 to the panes 14 of the insulated glass panel 12. The set screws 86 bear against the outer walls 110 of the glass support channels 84.

The vertical stile assembly 4 is assembled by placing the double sided adhesive tape strips 88 onto the inner walls 96 of the glass support channels 84. Each glass support channel 84 is then positioned within the main channel 82 over one of the positive stops 98. The vertical stile assembly 4 is installed about a vertical edge of the panel to be secured 12 by placing the panel between the glass support channels 84. The double sided adhesive tape strips 88 will then cause the inner walls 96 of the glass support channels 84 to adhere to the panes 14 of the panel to be supported 12. Thereafter, the set screws 86 are tightened. Inward axial movement of the setscrews 86 causes the glass support extrusions 84 to develop clamping force between the inner walls of the extrusions 84 and the panes or faces 14 of the panel to be secured 12.

It should be noted that upon loose assembly, i.e. prior to tightening of the set screws 86, of the vertical style 4 about an edge of the panel to be secured 12, there exists a predefined gap 114 between the outer wall 110 of the glass support channel and the positive stop 98 of the main channel 82. Upon tightening of the set screws 86, the outer wall 110 deflects inwardly until it bottoms out against the positive stop 98. With this configuration, the clamping force applied to the panel to be secured 12 can be precisely controlled. Precise control of the clamping force applied to panel to be secured 12 is of particular importance in insulated glass applications because the spacer 16 which separates the panes 14 of the panel to be secured 12 is typically of hollow construction and may be easily crushed. With the positive stop of the stile assembly 4 of the present invention, the stile assembly 4 may be readily installed on the panel to be secured 12 without concern for over torqueing the set screws and possibly crushing the spacer 16.

After the set screws 86 are torqued and the stile assembly 4 is thereby attached to the panel to be secured 12, to cover the holes 90 and set screws 86 and to otherwise provide for a pleasing esthetic appearance, cladding 92 is affixed about the main channel 82. The stile assembly 4 may also be equipped with a groove or channel 116 for receipt of either a snap in weather seal 118 or a decorative cap (not shown). Typically, a weather seal will be used in stile applications and a decorative cap will be used in door jamb applications.

Figure 6:
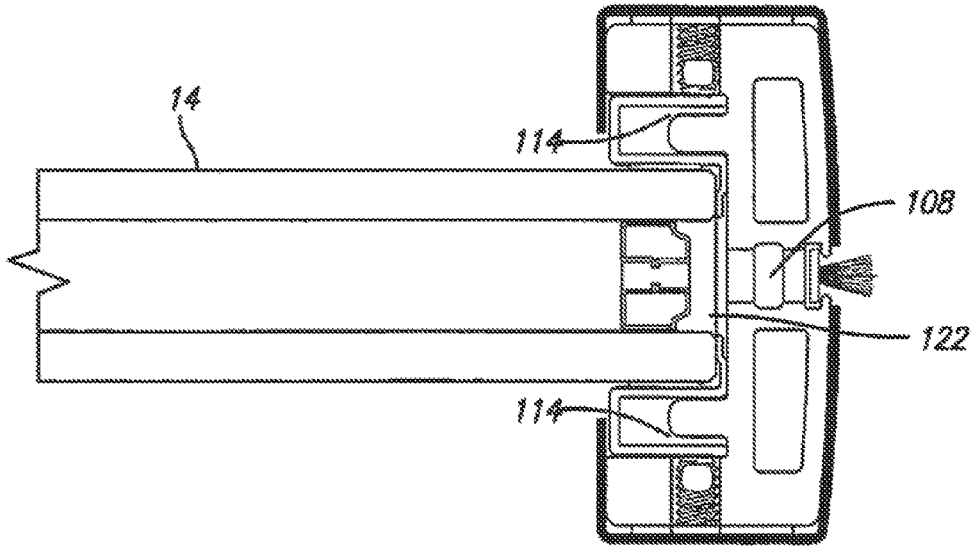
FIG. 6 is an exemplary cross-sectional view of a vertical stile or door jamb assembly of the present invention, taken along the line B-B of FIG. 7, showing a slot formed in the stile or door jamb assembly for the introduction of thermal epoxy.
Figure 7:
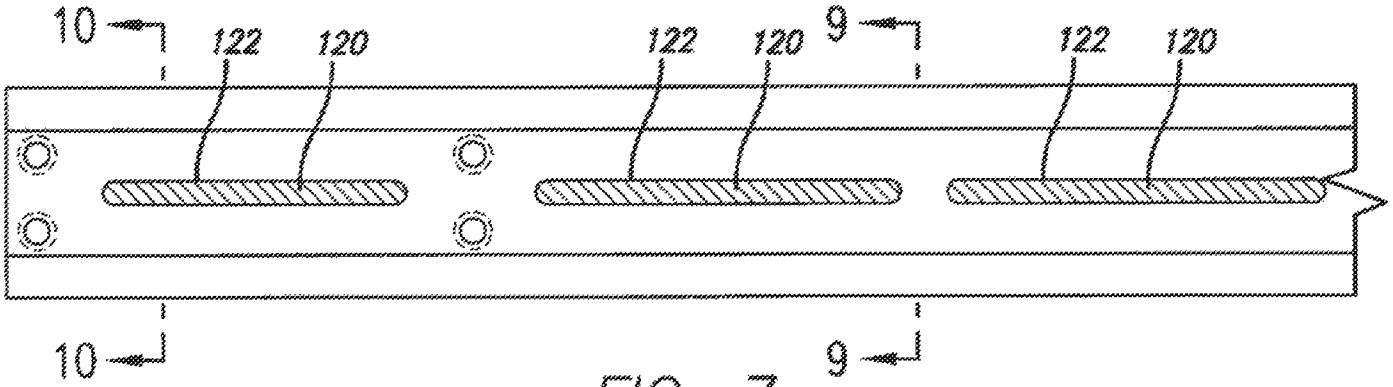
FIG. 7 is a bottom plan view of a vertical stile or door jamb assembly of the present invention.

With reference to FIGS. 6 and 7, in order to provide for improved thermal isolation of the stile assembly 4, slots 120 are machined at spaced intervals along the length of the main channel or extrusion 82. The slots 120 are centered above the center channel 108 and extend through the channel 108, the full depth of the main channel or extrusion 82. The slots 120 are subsequently filled a thermal epoxy 122, of which several types with good insulating qualities are known in the art.

With reference to FIG. 6, a mullion assembly 6 in accordance with the present invention is shown. The mullion assembly 6 serves to secure the vertical edges of two panels to be secured 12, when used in a wall partition. The mullion assembly 6 includes a T-section main body 124, a removable cap 126, weather seals 130 affixed to the T-section main body 124 and removable cap 126, as well as a clamp screw 128 and setting blocks or spacers 132. The setting blocks or spacers 132 prevent the ends of the glass panes 14 of the panels to be secured 12 from making direct contact with the T-section main body 124.

The T-section main body 124 comprises an integral horizontal cap portion 134 having proximate and distal ends and which is hollow to reduce weight and an integral vertical web portion 136. The integral vertical web portion 136 having an upper free end 141 bounded by upper horizontal wall 142, and further comprising first and second vertical walls 138 and 140, an intermediate horizontal wall 146, and a lower wall 144. The vertical walls 138 and 140 in conjunction with the upper horizontal wall 142 and intermediate horizontal wall 146 define an upper channel 148. The vertical walls 138 and 140 in conjunction with the intermediate horizontal wall 146 and the lower horizontal wall 144 define a lower channel 150. The lower channel 150 may be filled with thermal epoxy 148 to provide for thermal isolation of the T-section main body 124.

The removable cap 126 features a channel 152 which is configured to interface with the upper portion 141 of the integral web portion 136 of the T-section main body 124. A screw 128 passes through a clearance hole (not shown) in the removable cap 126 and engages a threaded hole (not shown) in the T-section main body 124. Tightening of the screw 128 creates clamping force between the weather seals 130 located on both the T-section main body 124 and removable cap 126. The degree of clamping force may be precisely controlled by varying the depth 154 of the channel 152 of the removable cap 126.

The weather seals 130 may be of snap-in design which interface with retention channels or grooves 156 formed in the proximate and distal ends of the T-section main body 124 and removable cap 126. To provide the T-section main body and removable cap 124 and 126 with a pleasing exterior appearance, cladding 160 may be applied to the exterior surface of the main body 124 and removable cap 126. The cladding 160 may conveniently secured to T-section main body and removable cap 124 and 126 by means of adhesive tape strips 158.

Figure 10:
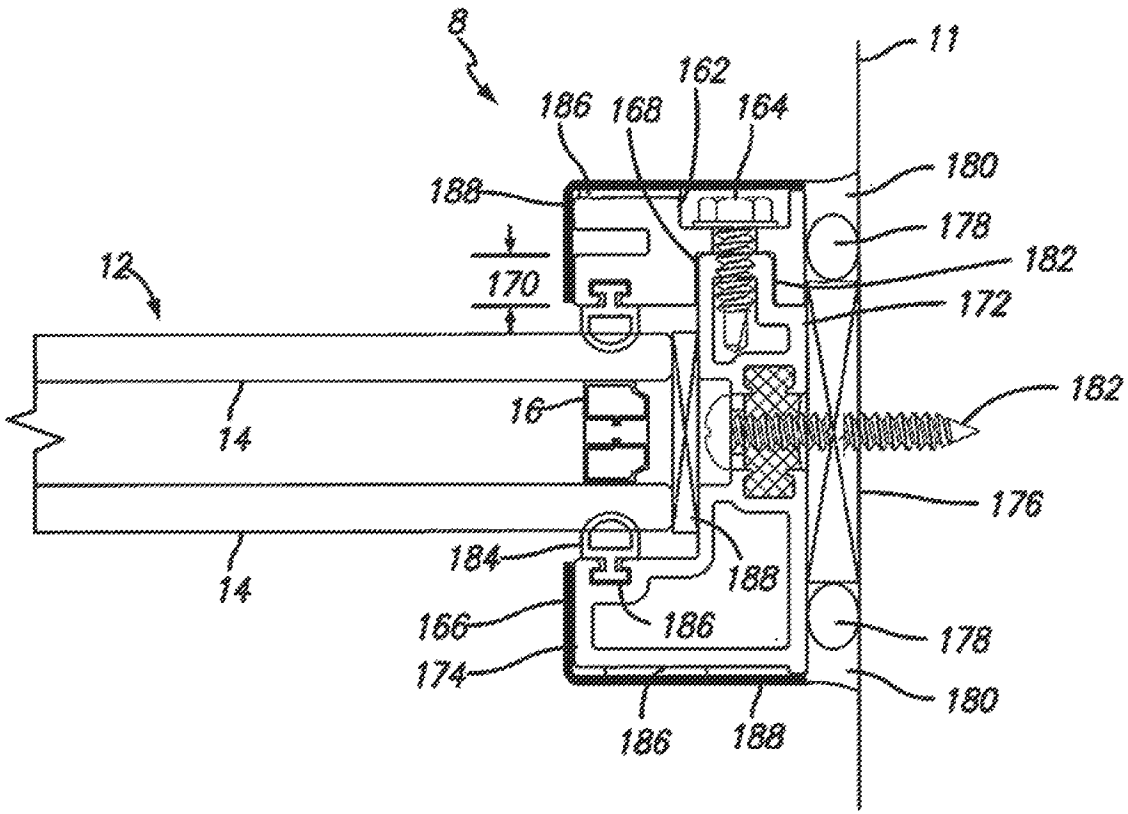
FIG. 10 is an exemplary end view of a vertical wall jamb assembly constructed in accordance with the present invention.

Referring now to FIG. 10, a wall jamb assembly 8 in accordance with the present invention is shown. The wall jamb assembly 8 serves to secure a vertical edge of a panel to be secured 12 to a wall 11. The wall jamb assembly 8 includes an L-section main body 166, a removable cap 162, weather seals 184 affixed to the L-section main body 166 and removable cap 162, as well as a clamp screw 164 for securing the removable cap 162 to the L-section main body 166, and a setting block or spacer 188 for preventing direct contact of the edges of the panes 14 of the panel to be secured 12 with the L-section main body 166.

The L-section main body 166 comprises an integral lower horizontal cap portion 174 having proximate and distal ends and which is hollow to reduce weight and, an integral vertical web portion 172, which may also have hollow channel portions to reduce weight. The removable cap 162 has proximate and distal ends and a channel 168 which is configured to interface with an upper portion 182 of the integral web portion 172 of the L-section main body 166. A screw 164 passes through a clearance hole (not shown) in the removable cap 162 and engages a threaded hole (not shown) in the L-section main body 166. Tightening of the screw 164 creates clamping force between the weather seals 184 located at the proximate and distal ends of removable cap 162 and integral cap portion 174 of the L-section main body 166.

Similar to the mullion assembly 6, the degree of clamping force in the wall jamb assembly 8 may be precisely controlled by varying the depth 170 of the channel 168 of the removable cap 162. Likewise, the weather seals 184 may be of snap-in design which interface with retention channels or grooves 186 formed in the L-section main body 166 and removable cap 162. Again like the mullion assembly 6, the L-section main body and removable cap 166 and 162 of the door jamb assembly 8 may be provided with a pleasing exterior appearance by applying cladding 188 to the exterior surface of the main body and removable cap. The exemplary means of applying cladding is to use double-sided adhesive tape strips 186. Other means such as liquid adhesives or mechanical fasteners are also suitable and are known in the art.

The wall jamb assembly 8 is secured to the wall 11 by means of a wall attachment screw 182, a spacer block 176, and gaskets 180 placed about the spacer block 176. Sealant such as RTV is used fill in the gap between the wall door jamb 8 and gasket 178. Many types of suitable sealants are known in the art.

Figure 11:
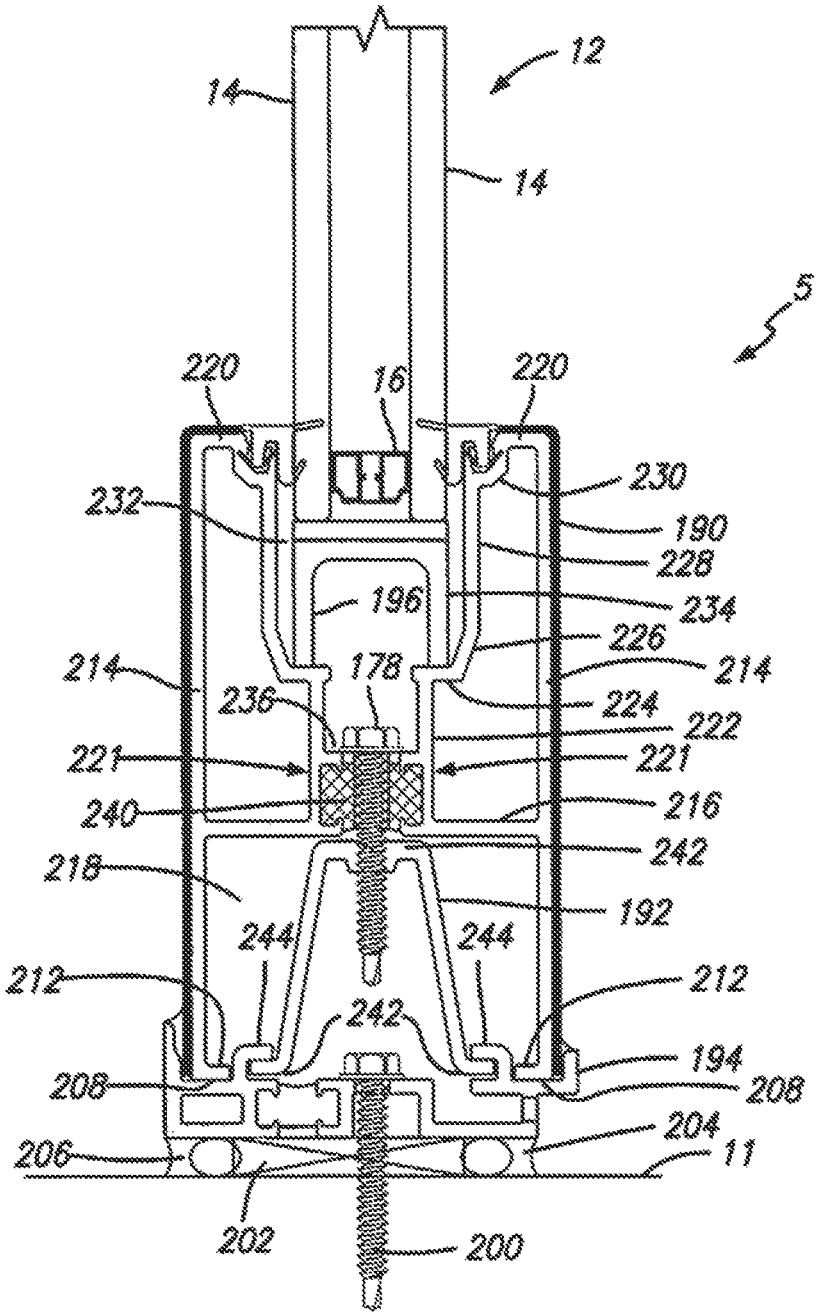
FIG. 11 is an exemplary end view of a horizontal sidelight rail assembly constructed in accordance with the present invention.

Referring now to FIG. 11, a sidelight rail assembly 5 in accordance with the present invention is shown. The sidelight rail assembly 5 serves to secure horizontal edges of a panel to be secured 12 to a wall 11, in a wall partition or fixed glass application. The sidelight rail assembly 5 comprises in principle part a rail body extrusion 190, a hat section extrusion 192, and a wall base extrusion 194.

The wall base extrusion is secured to the wall 11 by means of wall attachment screws 200, a spacer block 202, and gaskets 204 placed about the spacer block 202. Sealant 206, such as RTV, is used to fill in the gap between the wall base extrusion 194 and the gasket 204. The wall base extrusion 194 also includes channels 208 which are configured to receive flanges 212 of the sidelight rail body extrusion 190.

The sidelight rail body extrusion 190 has exterior vertical walls 214 and a horizontal intermediate wall 216. The vertical walls 214 and horizontal intermediate wall 216 define a lower channel 218 which extends downwardly of the horizontal wall 216 and is bounded by the vertical walls 214.

Extending upwardly from the horizontal intermediate wall 216 are irregular vertically ascending walls 221 which comprise generally straight segments 222, 224, 226, 228 and 230. The irregular vertically ascending walls 221 define an upper channel space 232 therebetween. The panel to be secured 12 is received with the channel space 232. The depth of the panel to be secured 12 is set by a spacer 234 which rests upon horizontal segments 224 of the irregular walls 221.

The sidelight rail body extrusion 190 further includes a center channel space 238 which is defined the intersections of horizontal intermediate wall 216, intermediate wall 236 and vertical wall segments 222 of irregular walls 221. The center channel space 238 may be filled with thermal epoxy 240 for improved thermal isolation.

Attachment screws 198 secure the sidelight rail body extrusion 190 to an upper web 242 of the hat section extrusion 192. Outwardly facing flanges 242 of the hat section extrusion 192 engage with channels 244 of the wall base extrusion 194 to secure the hat section extrusion 192 to the wall base extrusion 194.

The vertical stile 4, mullion 6, wall jamb 8 and sidelite rail 5 are preferably aluminum extrusions. Aluminum is preferred for its light weight and ease with which complex shapes may be produced using the extrusion process with the material. Other metallic and thermoplastic materials may also be suitable. The cladding used on the stile, mullion, wall jamb and sidelight rail assemblies may be of a number of materials with stainless steel, brass or aluminum in polished or brushed finishes being preferred. Aluminum cladding may also be given a pleasing anodized finish.

The foregoing detailed description and appended drawings are intended as a description of the presently preferred embodiments of the invention and are not intended to represent the only forms in which the present invention may be constructed and/or utilized. Those skilled in the art will understand that modifications and alternative embodiments of the present invention which do not depart from the spirit and scope of the foregoing specification, drawings, and appendix of the claims below are possible and practical. It is intended that the claimed invention covers all such modifications and alternative embodiments.

The invention claimed is:

1. A rail assembly for releasably securing a panel, the rail assembly comprising:

a rail body having mutually opposed inclined surfaces, angled inwardly towards the panel to be secured;

a spring action clamping member, having mutually opposed walls, the walls having mutually opposed upper ends, the upper ends configured to slide against the inwardly inclined surfaces of the rail body;

wherein the spring action clamping member is movable between an open position wherein the panel to be secured may be freely removed from the rail body and a closed position wherein the panel to be secured is clamped within the rail body;

a screw engaged with the rail body having an end in contact with the spring action clamping member; and wherein actuation of the screw from the open position causes the clamping member to move upwardly causing the upper ends of the mutually opposed walls of the clamping member to slide upwardly against the mutually opposed inclined surfaces of the rail body, said upward motion causing the upper ends to translate inwardly, applying clamping pressure to each side of the panel to be secured.

2. The rail assembly for releasably securing a panel of claim 1, wherein the upper ends of the mutually opposed walls of the spring action clamping member are radiused on a side that contacts the inclined surfaces of the rail body.

3. The rail assembly for releasably securing a panel of claim 2, wherein the upper ends of the mutually opposed walls of the spring action clamping member include a compression gasket on a side opposite that of the side that contacts the inclined surfaces of the rail body.

4. The rail assembly for releasably securing a panel of claim 1, wherein each of the mutually opposed walls of the spring action clamping member includes a u-shaped element, wherein the u-shaped element acts as a spring member.

5. The rail assembly for releasably securing a panel of claim 1, wherein the rail body and the spring action clamping member are configured to include a positive stop feature which limits upward travel of the spring action clamping amber.

6. The rail assembly for releasably securing a panel of claim 5, wherein the positive stop feature comprises center channels having mutually opposed walls formed on the rail body and spring action clamping member, the center channel of the spring action clamping member being vertically movable within the center channel of the rail body, the mutually opposed walls of the center channel of the rail body including inwardly facing hook ends, and the mutually opposed walls of the center channel of the spring action clamping member including outwardly facing flanges, wherein upward movement of the spring action clamping member is limited by contact of the outwardly extending flanges of the center channel of the spring action clamping member with the inwardly extending hook ends of the center channel of the rail body.

7. The rail assembly for releasably securing a panel of claim 1, wherein the screw Is engaged with the rail body by means of threads formed in the rail body.

8. The rail assembly for releasably securing a panel of claim 1, wherein the rail body is surrounded by decorative cladding.

9. A stile assembly releasably securable about the edges of a panel to be secured, comprising:

a main channel configured to receive mutually opposed glass support channels, the main channel having mutually opposed positive stops;

the mutually opposed glass support channels having a C-channel configuration having inner and outer walls, wherein each glass support channel is disposed within the main channel such that the positive stops of the main channel protrude upwardly within the C-channel of the glass support channels;

wherein each inner wall of the glass support channels abuts a face of the panel to be secured;

set screws threadably engaged within the main channel and configured such that an end of each set screw bears against an outer wall of the glass support channels; and wherein tightening the set screws causes the outer walls of the glass support channels to translate inwardly against the positive stops of die main channel thereby creating a controlled clamping force between the inner walls of the glass support channels and the faces of the panel to be secured.

10. The stile assembly releasably securable about the edges of a panel of claim 9, wherein adhesive tape strips are disposed between the inner walls of the glass support channels and the faces of the panel to be secured.

11. The stile assembly releasably securable about the edges of a panel of claim 9, wherein the main channel is surrounded by decorative cladding.

12. A rail and stile system for framing a door panel, comprising:

a rail assembly for releasably framing horizontal edges of a panel to be secured, the rail assembly comprising:

a rail body having mutually opposed inclined surfaces, oriented to be generally angled inwardly towards the panel to be secured;

a spring action clamping member, having mutually opposed walls, the walls having mutually opposed upper ends, the upper ends configured to slide against the inwardly inclined surfaces of the rail body;

wherein the spring action clamping member Is movable between an open position wherein the panel to be secured may be freely removed from the rail body and a closed position wherein the panel to be secured is clamped within the rail body;

a screw engaged with the rail body having an end in contact with the spring action camping member; and wherein actuation of the screw from the open position causes the clamping member to move upwardly causing the upper ends of the mutually opposing walls of the clamping member to slide upwardly against the mutually opposed inclined surfaces of the rail body, said upward motion causing the upper ends to translate inwardly, applying clamping pressure to each side of the panel to be secured; and a stile assembly for releasably framing vertical edges of a panel to be secured, the stile assembly comprising:

a main channel configured to receive mutually opposed glass support channels, the main channel having mutually opposed positive stops;

the mutually opposed glass support channels having a C-channel configuration having inner and outer walls, wherein each glass support channel is disposed within the main channel such that the positive stops of the main channel protrude upwardly within the C-channel of the glass support channels;

wherein each inner wall of the glass support channels abuts a face of the panel to be secured;

set screws threadably engaged within the main channel and configured such that an end of each set screw bears against an outer wall of the glass support channels; and wherein tightening the set screws causes the outer walls of the glass support channels to translates inwardly against the positive stops of the main channel thereby creating a controlled clamping force between the Inner walls of the glass support channels and the faces of the panel to be secured.

13. The rail and stile system for framing a panel of claim 12, wherein the upper ends of the mutually opposed walls of the spring action clamping member are radiused on a side that contacts the inclined surfaces of the rail body.

14. The rail and stile system for framing a panel of claim 13, wherein the upper ends of the mutually opposed walls of the spring action clamping member include a compression gasket on a side opposite that of the side that contacts the inclined surfaces of the rail body.

15. The rail and stile system for framing a panel of claim 12, wherein each of the mutually opposed walls of the spring action clamping member includes a u-shaped element, wherein the u-shaped element acts as a spring member.

16. The rail and stile system for framing a panel of claim 12, wherein the rail body and the spring action clamping member are configured to include a positive stop which limits upward travel of the spring action clamping member.

17. The rail and stile system for framing a panel of claim 16, wherein the positive stop comprise center channels having mutually opposed walls formed on the rail body and spring action clamping member, the center channel of the spring action clamping member being vertically movable within the center channel of the rail body, the mutually opposed walls of the center channel of the rail including inwardly facing book ends, and the mutually opposed walls of the center channel of the spring action clamping member including outwardly facing flanges, wherein upward movement of the spring action clamping member is limited by contact of the outwardly extending flanges of the center channel of the spring action clamping member with the inwardly extending book ends of the center channel of the rail body.

18. The rail and stile system for framing a panel of claim 12, wherein the screw is engaged with the rail body by means of threads formed in the rail body.

19. The rail and stile system for framing a panel of claim 13, wherein the rail body of the rail assembly and main channel of the stile assembly are surrounded by decorative cladding.

* * * * *